US005142195A

United States Patent [19]

Heider et al.

[11] Patent Number: 5,142,195

[45] Date of Patent: Aug. 25, 1992

[54] PINCH-SEALED HIGH PRESSURE DISCHARGE LAMP, AND METHOD OF ITS MANUFACTURE

[75] Inventors: Juergen Heider; Achim Gosslar, both of Munich, Fed. Rep. of Germany

[73] Assignee: Patent Treuhand Gesellschaft fur Elektrische Gluhlampen m.b.H., Munich, Fed. Rep. of Germany

[21] Appl. No.: 680,413

[22] Filed: Apr. 4, 1991

[30] Foreign Application Priority Data

Apr. 12, 1990 [DE] Fed. Rep. of Germany ..... 4011931

[51] Int. Cl.[5] ..... H01J 61/30; H01J 61/36

[52] U.S. Cl. ..... 313/623; 313/634; 313/332; 445/26; 445/43

[58] Field of Search ..... 313/623, 634, 331, 332, 313/611, 631, 285; 445/26, 43

[56] References Cited

U.S. PATENT DOCUMENTS

| | | | |
|---|---|---|---|
| 3,205,395 | 9/1965 | Buchwald | 313/285 |
| 3,548,245 | 12/1970 | Biscoff | 313/623 X |
| 3,742,283 | 6/1973 | Loughridge | 313/623 X |
| 4,396,857 | 8/1983 | Danko | 313/634 |
| 4,540,373 | 9/1985 | Rothwell et al. | 313/634 X |
| 4,686,419 | 8/1987 | Block et al. | 313/639 X |
| 4,806,816 | 2/1989 | de Vrijer | 313/331 |
| 4,850,499 | 7/1989 | White et al. | 313/634 X |
| 4,859,899 | 8/1989 | Keefe et al. | 313/634 X |
| 4,891,555 | 1/1990 | Ahlgren et al. | 313/634 |

FOREIGN PATENT DOCUMENTS

| | | |
|---|---|---|
| 0183403 | 6/1986 | European Pat. Off. . |
| 2002954 | 2/1979 | United Kingdom . |

OTHER PUBLICATIONS

General lighting products, Osram; 1991.

*Primary Examiner*—Donald J. Yusko
*Assistant Examiner*—Ashok Patel
*Attorney, Agent, or Firm*—Frishauf, Holtz, Goodman & Woodward

[57] ABSTRACT

A double-ended, double-sided pinch seal discharge lamp has pinch seals at opposite ends of a discharge vessel, in which the broad side surfaces of the pinch seal, retaining a molybdenum foil (8) is formed with lateral constrictions or indentations (16) located at the transition zone between the pinch seal and the bulbous or discharge vessel portion (3). Preferably, excess glass material from the side surfaces or ribs (14) formed on the side surfaces of the pinch or press seal is squeezed, in the transition zone, towards the bulb or central region (3) during the pinch sealing process to form reinforcement ribs (17), thereby strengthening the transition zone between the pinch seal (5) and the bulb portion (3) of the lamp.

19 Claims, 9 Drawing Sheets

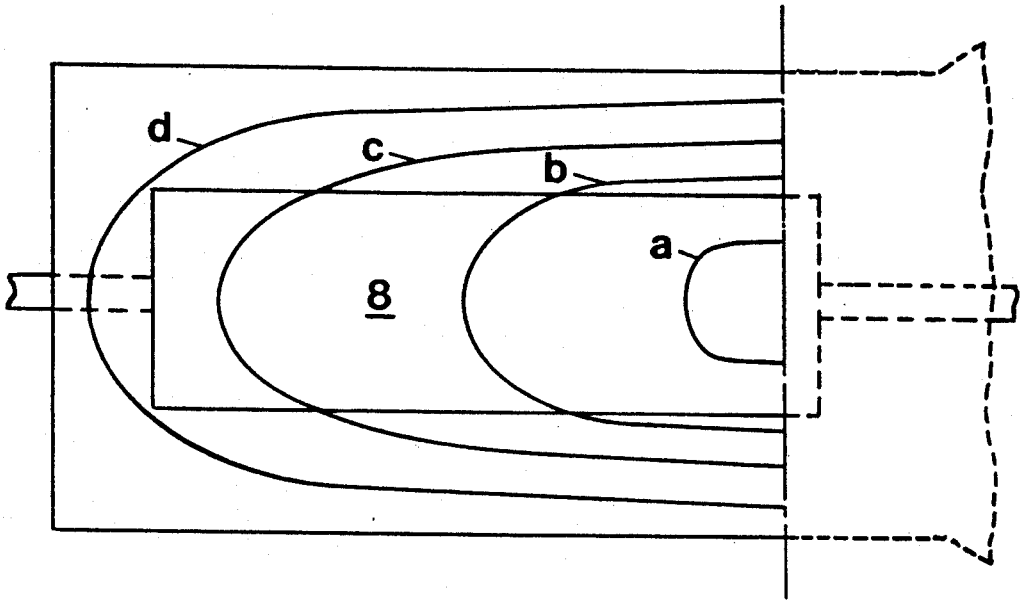
FIG. 4a - PRIOR ART
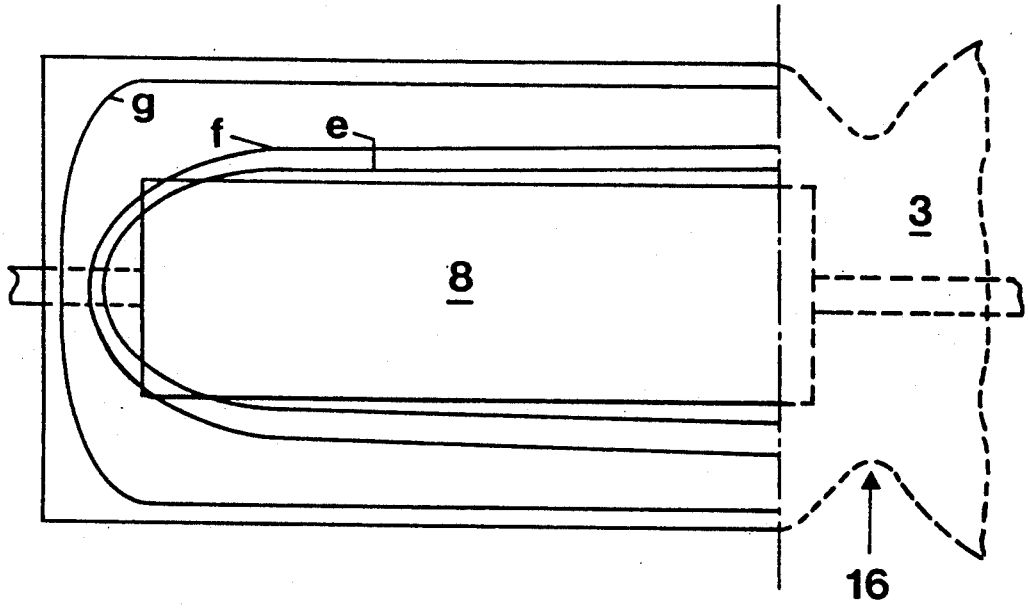
FIG. 4b

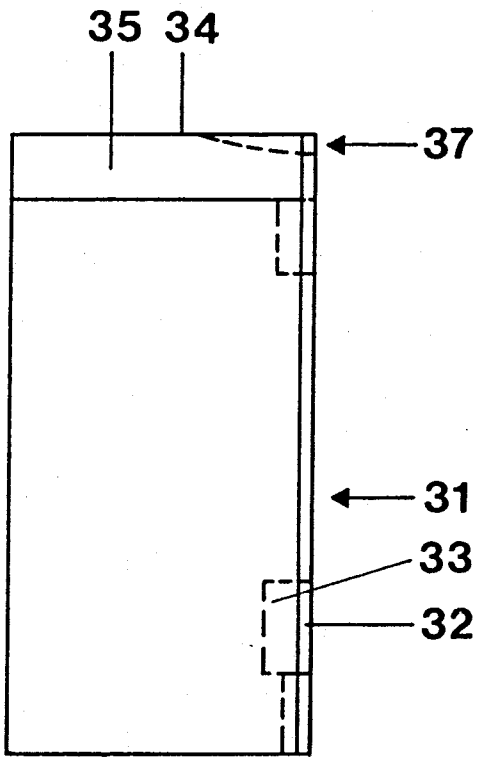
FIG. 7a2
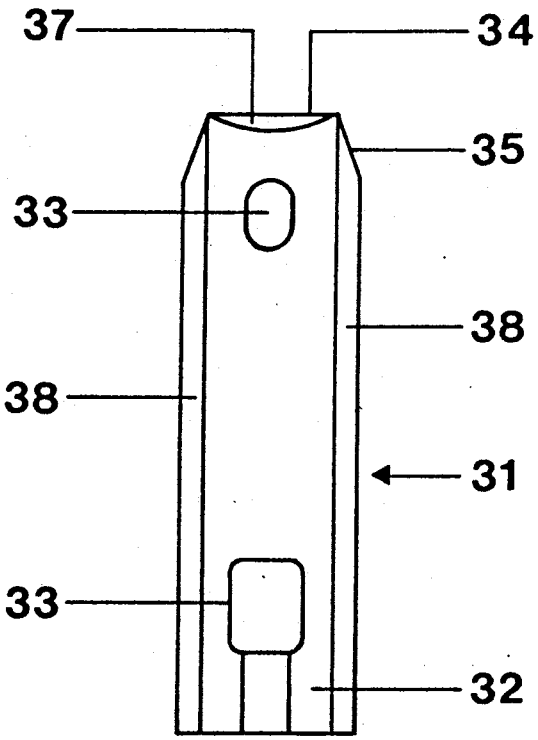
FIG. 7a1

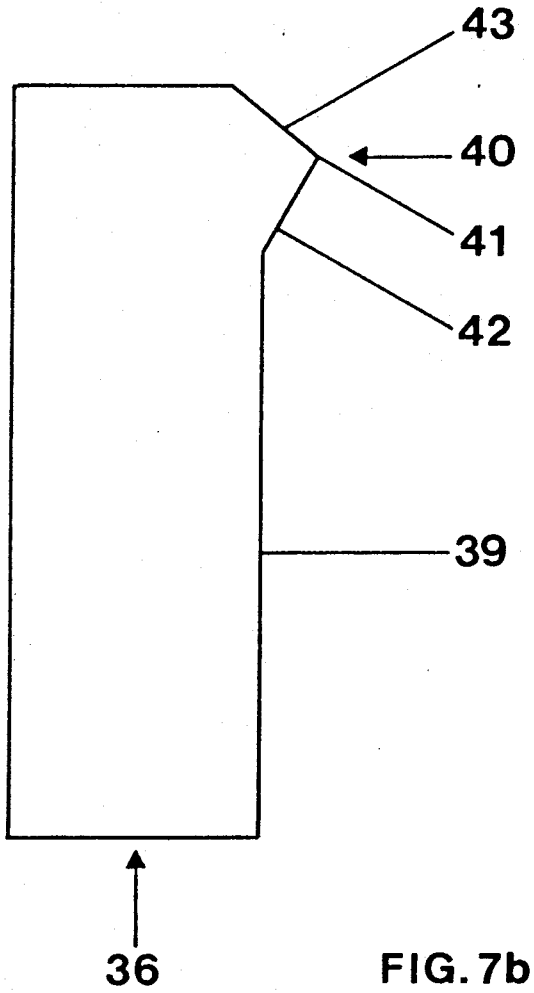
FIG. 7b2
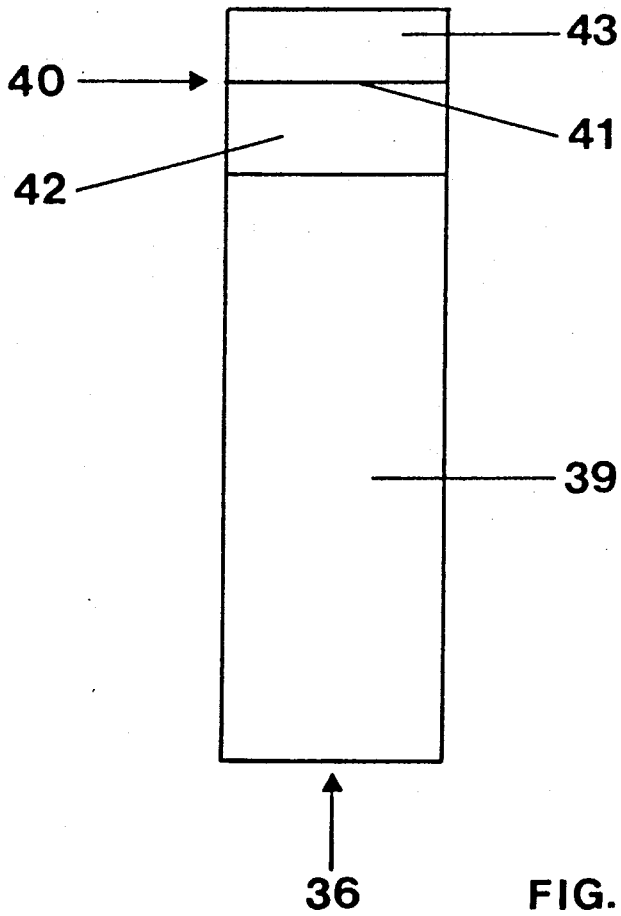
FIG. 7b1

PINCH-SEALED HIGH PRESSURE DISCHARGE LAMP, AND METHOD OF ITS MANUFACTURE

Reference to related patents, the disclosures of which are hereby incorporated by reference:

U.S. Pat. No. 4,806,816, de Vrijer

U.S. Pat. No. 4,396,857, Danko

Reference to related application, assigned to the assignee of the present application:

U.S. Ser. No. 07/500,760, filed Mar. 28, 1990, Heider and Gosslar, the inventors hereof.

FIELD OF THE INVENTION

The present invention relates to high-pressure, double-ended discharge lamps and to a method of making the lamps which may, but need not have, an outer envelope, and which are especially suitable for association with optical systems, such as reflectors, lens elements, and the like, and which are especially suitable for stage, motion-picture or television illumination with power ratings between about 400 to 4000 W.

BACKGROUND

Discharge lamps, and particularly discharge lamps which have a metal halide fill, usually have a discharge vessel of quartz glass. Such lamps are particularly suitable for association with optical systems, such as a light beam directing elements, search lights, headlights, or flood lights. Typical power ratings are between about 400 to 4000 W. Lower power lamp types, that is, lamps having a power rating of, for example, 150 W, can also be used for display window illumination or for general service illumination, and particularly where an intense light source of high efficiency is needed, which is not subject to frequent high ON/OFF cycling rates.

The referenced U.S. Pat. Nos. 4,396,857 and 4,806,816 show and describe double-ended, that is, double-sided miniature high-pressure lamps of lower power, that is, lamps having a power rating of about 35 W, and which have an outer bulb or envelope. These lamps have two pinch seals. The discharge vessel volume is less than 1 $cm^3$. It is desirable to prevent accumulation of excess metal halides at cold spots, in the parts of the vessel behind the electrodes and to ensure precise positioning of the electrodes within the discharge bulbs. To provide for precise positioning and as a means against cold spots, the lamps have pinch seals which join an essentially cylindrical transition region towards the discharge vessel itself. The discharge vessel, usually, is of somewhat bulbous or barrel shape. This transition region is constricted in the plane of the pinch seal, and expanded or extended with reference to the narrow sides of the pinch seal. The transition region, thus, has an increased wall thickness and an accumulation of glass mass with respect to the wall thickness of the discharge vessel as such. The result will be an undesired relatively good heat conduction and heat transmission from the vessel to the pinch seals and, further, a relatively good heat radiation due to the large radiating surface of the cylindrical transition region. The heat damming effect, to be obtained, thus is not entirely satisfactory. Manufacturing such lamps is relatively complicated since the transition region is made in two manufacturing steps. The pinch sealing step itself is done with two pinch jaws.

U.S. Ser. No. 07/500,760 describes a double-sided, that is double-ended, double pinched metal halide discharge lamp intended to have high power, in the order of 1000 to 2000 W, for example, and suitable for operation without an external surrounding bulb or transparent housing. Lamps of that type are particularly critical with respect to heat balance and the heat damming effect is especially important since, otherwise, the halide vapor pressure will not reach its desired value and hence the color temperature of the lamp will not be an optimum, as desired. In part, a heat damming coating is used. This heat damming or heat retention coating, however, increases scattering or spreading of the color of the light emitted by the lamp, and also causes some shadowing by decreasing light transmission. It has been found, in operation, that these lamps, which are intended to be installed without an external vessel, may break at the transition region to the central discharge vessel. The end regions are retained in bases and rough handling of the bases, or shifting in their sockets, may cause the lamps to break.

THE INVENTION

It is an object to improve the construction of double-sided high-pressure discharge lamps in which the heat damming effect at the ends of the discharge vessel is further improved, and there increases the temperature in the transition region, to improve the color temperature. It is an additional object to provide a method to manufacture such a lamp quickly and inexpensively, especially by automatic manufacturing machinery.

Briefly, the broad face surface of each pinch seal, adjacent the bulbous region is reduced in width, that is, is formed with constrictions which define a transition region between the broad face surface and the region of the bulb close thereto and which is arranged that the thickness of the pinch or press seal remains essentially constant. In accordance with a preferred feature of the invention, the pinch or press seal, in cross section, has generally I-beam shape, with lateral ridges adjacent the narrow sides which can be extended to form reinforcements.

In accordance with another feature of the invention, the pinch seal is made by applying two main pinch jaws against the end portion of the softened glass vessel, the main jaws having lateral side surfaces at their pinching or compression surface. Two additional or auxiliary side pinch jaws shape the pinch seal, the auxiliary jaws being formed with a projecting tip having an inclined surface. The pinch seal and the transition region of the lamp can be shaped and made in a single sealing and shaping operating step. This is a substantial manufacturing advantage, since a special step to form the transition region between the pinch seal and the discharge vessel portion of the lamp is not needed; rather, the constriction can be formed directly as a portion of of the pinch seal in a single operation during the formation of the pinch seal.

In accordance with a feature of the invention, the end regions of the vessel, formed as pinch seals, are constricted only in the plane of the pinch seal, without being thickened in transverse direction, with respect to the narrow side of the pinch seal. This substantially reduces the quantity of glass which is present in that region, and thereby decreases the radiating surface which may radiate heat. The result will be a much better heat retention effect, leading to an increase in temperature at the ends of the vessel behind the electrodes. An increase of from between 50° to 100° C. can, typically, be obtained. This increase permits elimination of special heat retention coatings or the like, and thus decreases the scattering or spreading of the color temperature and permits full transmission of light, thus increasing the overall light available from the lamp by between 5–10%, with improved color rendition.

It has been found, surprisingly, that the present invention also substantially improves the maintenance of color temperature throughout the life of the lamp. Although an initial decrease cannot be avoided, it starts from a substantially lower initial value in comparison with prior art. The decrease occurs because of diffusion of fill into capillaries at the seal, which has the effect of forming a metal halide sump. These capillaries occur along the electrode shafts leading toward sealing foils and extending from the discharge vessel. The thermal coefficients of expansion of the electrode shafts, typically made of tungsten, and the coefficients of the quartz glass bulb are very different. This sump of metal halide then no longer can contribute to the maintenance of vapor pressure within the discharge vessel.

Use of a cylindrical transition region, in accordance with the prior art, resulted in comparatively long capillary passages, which arose due to the differential thermal coefficients of expansion, so that the decrease in color temperature, due to the accumulation of metal halides, was marked. In contrast, the structure of the present invention permits maintaining the length of the capillaries, in spite of the constriction, at a very short level, so that the decrease in color temperature is effectively reduced. The length of the capillaries will be, at the most, about 10% of the length of the discharge vessel, measured along the longitudinal axis of the discharge vessel. Lamps having an essentially cylindrical transition region will have capillaries of about 28% of the length of the discharge region—for example in the structure of U.S. Pat. No. 4,396,857; and the length of the seal described in the more recent U.S. Pat. No. 4,806,816 is even longer, about 54% of the length of the discharge vessel.

When using high-power lamps without an outer surrounding or enclosing bulb or vessel, the advantages of shorter length of capillaries extending from the discharge vessel and maintenance of color temperature are particularly important.

In accordance with a preferred feature of the invention, the end region of the pinch seal is shaped, in cross section, to have roughly the configuration of an I-beam or a double T, in which the stems of the T are joined. Consequently, the narrow sides of the pinch seal are somewhat thickened to form end ridges, with respect to the plane of the pinch seal. In accordance with a particularly preferred embodiment, these end ridges spread out to form additional struts or ribs towards the discharge region of the bulb, for example extending over the entire length of the constriction.

This provides for additional mechanical stabilization of the pinch seals at the point where the pinch seal merges with the glass bulb, that is, in the transition region, which is the region particularly subject to mechanical stress, e.g. in case of mishandling or maladjustment of sockets in which the base or bases of the lamp are fitted, or due to temperature variation caused by switching the lamps on and off. These ribs or reinforcement ridges reliably prevent breaking of the transition region and hence the failure of the lamp. The constriction, as well as the reinforcement by the ridges, is particularly desirable when used with lamps without an outer surrounding housing or outer bulb. The combination of the constriction, together with the ridges, results in a particularly effective combination, since the glass material which is squeezed when forming the constriction can be repositioned during the pinch seal operation to form the reinforcement ridges.

The system permits another advantage, namely to ensure precise centering of the electrode systems within the lamp.

In accordance with another preferred feature of the invention, a centering bump or button is applied to at least one of the broad sides of the pinch seal. This centering button can be formed without any additional manufacturing costs, since it can be made during the pinch-sealing step by forming a depression in at least one of the pinch jaws at the pinching surface.

In accordance with a preferred feature of the invention, the region immediately adjacent the end portion of the discharge region of the bulb is re-shaped during the pinch sealing operation, and when the glass of the bulb is still soft. The central region of the bulb, that is, the discharge region, will receive tangential inclinations at its ends, which decrease the discharge volume behind the electrodes.

The method of manufacture in accordance with the invention, of the lamp, is characterized by high efficiency and simplicity, since it permits manufacture with a high time-cycling rate. Shaping the lamp bulb, and forming the constriction as well as the reinforcement ribs, and centering of the electrode system, can all be done in a single operating step. Each pinch seal is done with four pinch jaws, including two main pinch jaws which form the broad sides of the pinch seal, and two auxiliary lateral pinch jaws which are formed with a roof-like or essentially triangular projection. The main pinch jaws include, at least in one of them, a centering depression to form the centering button; they are, additionally, formed with inclined surfaces which, upon pinch-sealing the bulb ends by operating against the softened quartz glass, form the reinforcement ridges. The operation of the auxiliary jaws can be slightly retarded with respect to the main jaws, which results in particularly good formation of the pinch seal.

DRAWINGS

Figure 1:
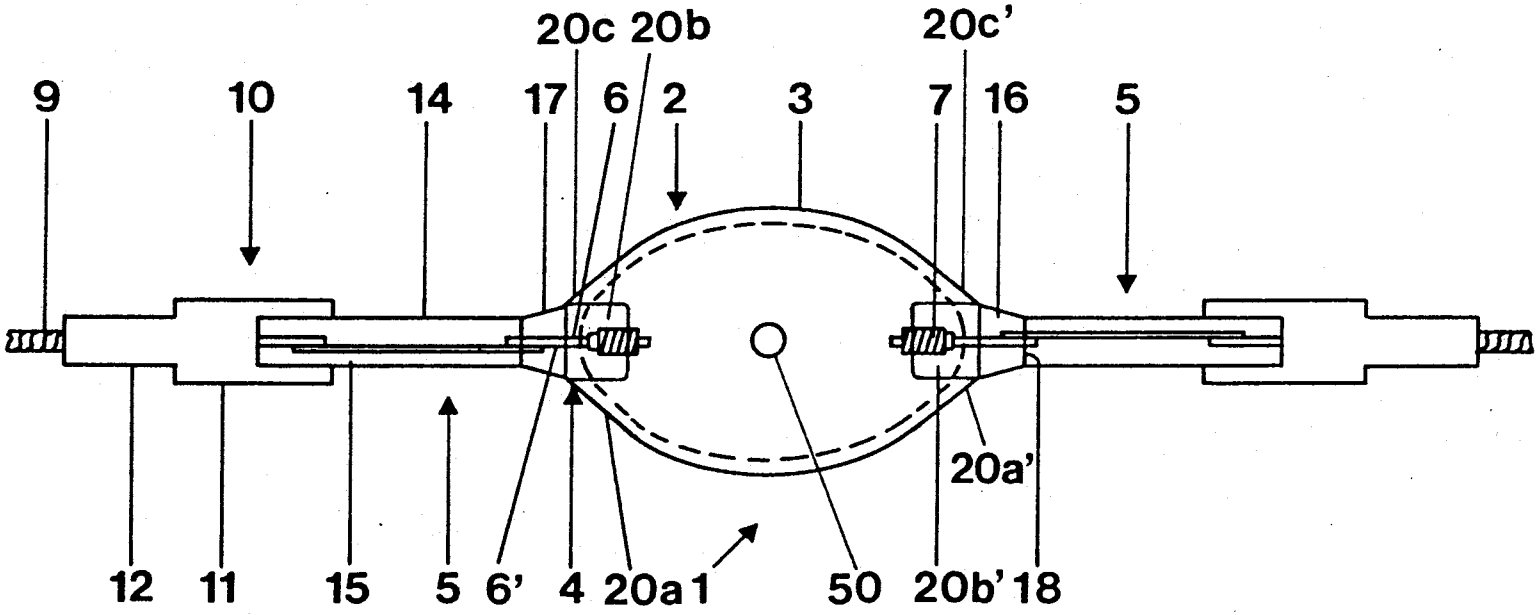
FIG. 1 is a highly schematic side view of a double-ended high-pressure discharge lamp having a power rating of 2000 W.
Figure 2:
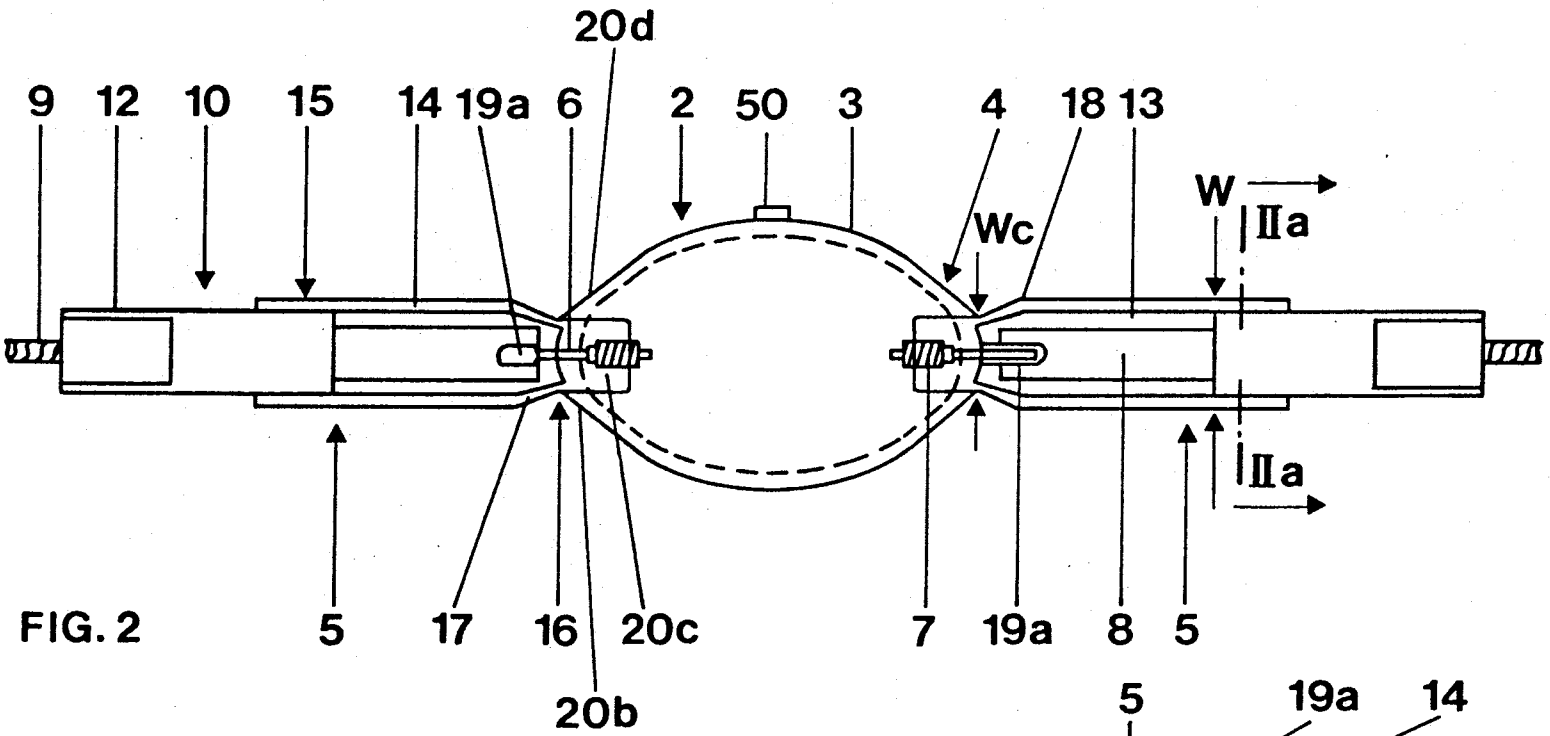
FIG. 2 shows the lamp of FIG. 1, rotated by 90° about its longitudinal axis.
Figure 2A:
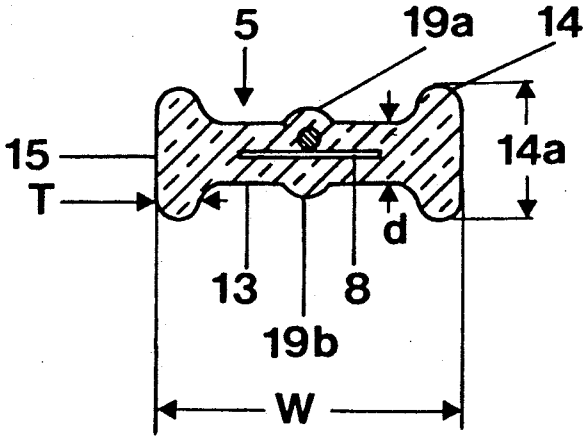
Figure 3:
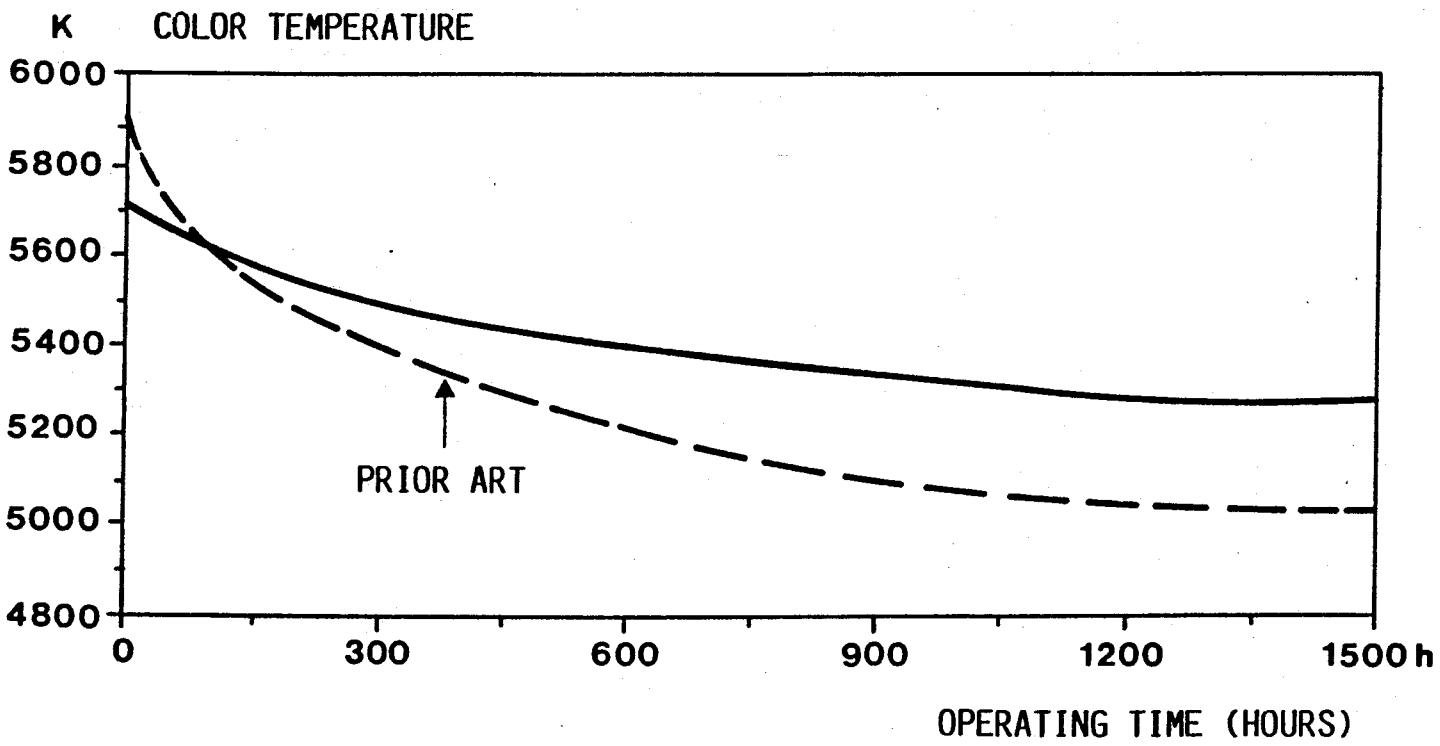
Figure 5:
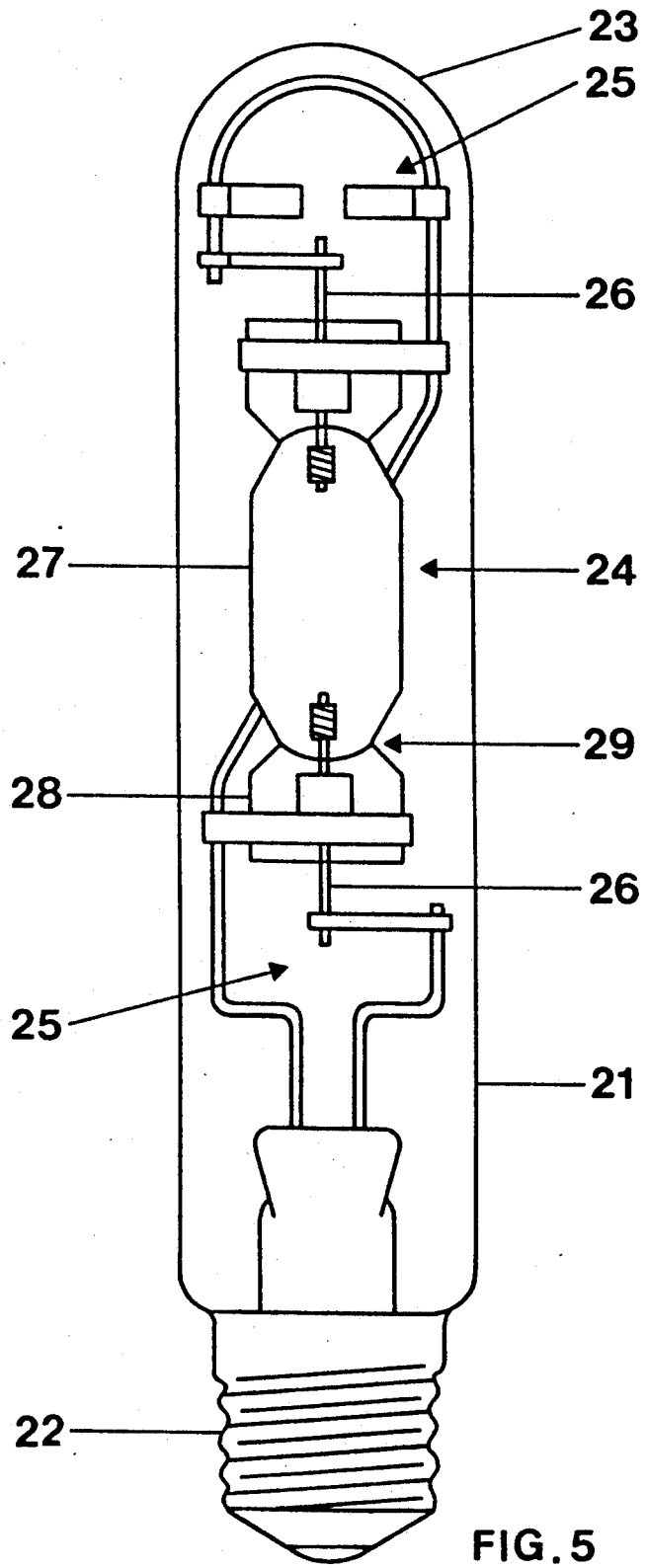
Figure 6:
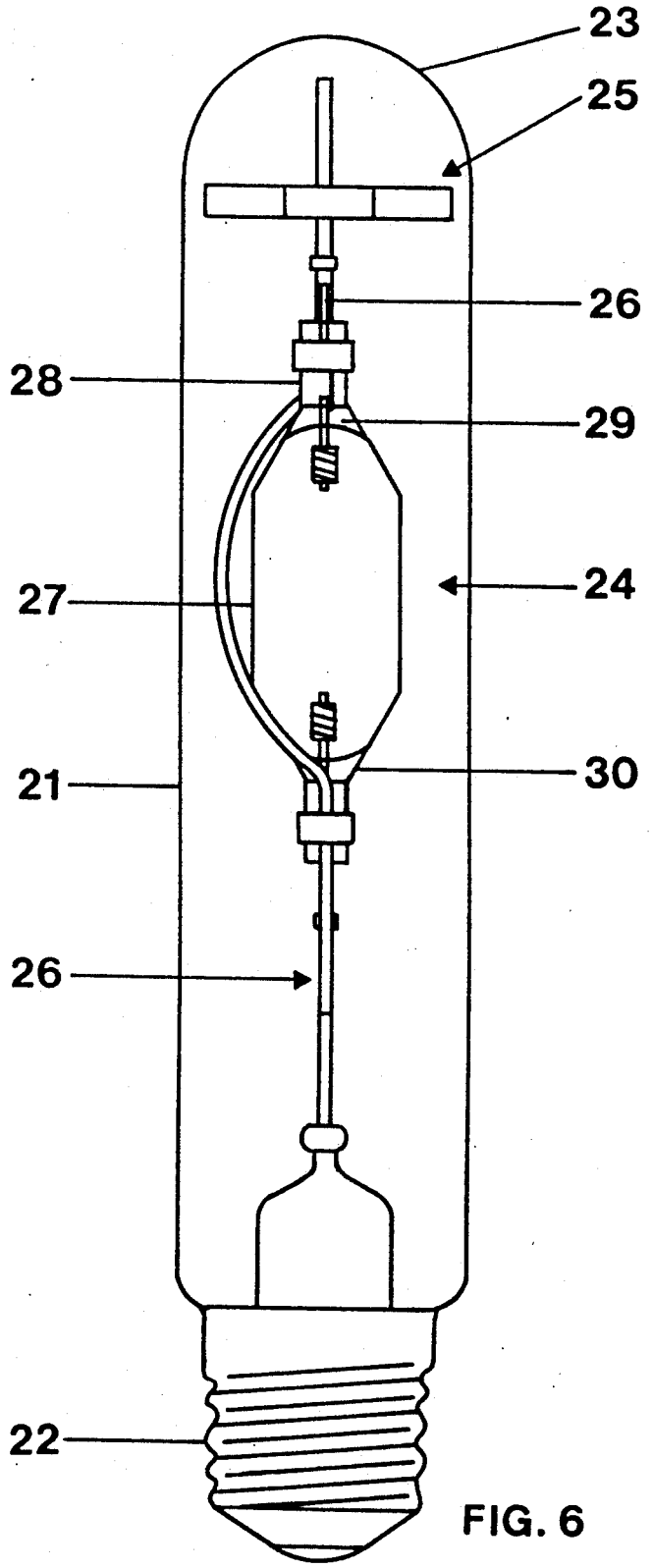

FIG. 2*a* is a cross section taken along line IIa-IIa of FIG. 2, and omitting the base;

FIG. 3 is a diagram of color temperature of the lamp (ordinate) with respect to operating time in hours (abscissa);

FIGS. 4*a* and 4*b* are temperature distribution diagrams in the pinch seal of high-pressure discharge lamps, in which FIG. 4*a* shows the temperature distribution in a prior art lamp, and FIG. 4*b* in the lamp of the present invention;

FIG. 5 is a side view of a high-pressure discharge lamp of 400 W rating;

FIG. 6 is an illustration of the lamp of FIG. 5, rotated 90° about its vertical axis;

FIGS. 7*a*1 is a front view of a pinching or pressing jaw to make the pinch seal in accordance with the method of the present invention;

FIG. 7*a*2 is a side view of the jaw of FIG. 7*a*1;

FIG. 7*b*1 is a front view of one auxiliary jaw;

FIG. 7b2 is a side view of the jaw of FIG. 7b1, and

Figure 8:
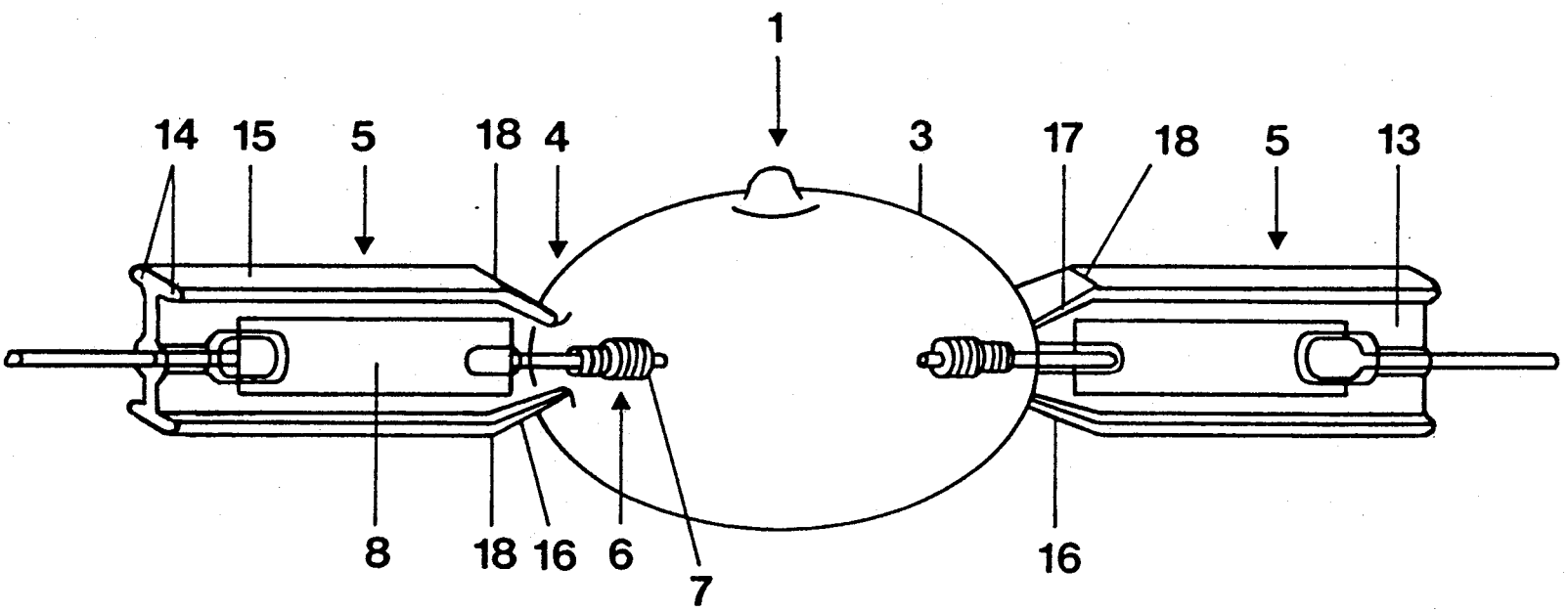

FIG. 8 is a pictorial view of the lamp of FIGS. 1 and 2, omitting the tangential inclinations at the ends, for clarity of illustration.

DETAILED DESCRIPTION

FIG. 1 shows a 2000 W lamp 1, about 19 cm long. Such a lamp does not require an outer bulb or transparent enclosure. It is intended for use with a reflector in axial alignment, not shown. Its bulb 2 consists of a central region 3 forming a discharge vessle, and two end regions, extending at opposite ends from the central region 3. The bulb vessel, forming a discharge vessel 3, is made of quartz glass, and is approximately isothermal. The wall thickness of the quartz glass can be 2 mm or 2.5 mm, for example, and forming the central region, which is essentially barrel-shaped. The generatrix of the barrel-shaped central or bulbous region 3 is a circular arc having a radius of 38.25 mm. The widest outer diameter of the barrel-shaped central region 3 is 36 mm, and is axial length about 51 mm. The outer diameter of the ends or end portions 4 of the bulbous vessel is about 16 mm. The discharge volume, then, will be about 22 $cm^3$. The end portion 4 is immediately adjacent an end region in which a pinch seal 5 is formed.

The electrodes 6 are made of tungsten, and are rod-shaped. The electrode tips are spaced from each other by about 30 mm, and are secured in axial position in the end region 5. A double layer wrap winding 7 is applied around the electrodes 6 in the vicinity of the tips of the electrodes. The end regions 5 have a length of about 40 mm, and a width W of about 16 mm. The electrodes are electrically connected to the outside by molybdenum foils 8 which are pinch-sealed to be vacuum tight in pinch seals. Current supply leads, not shown, are connected to the remote ends of the molybdenum foils 8, and in turn connected to flexible cables 9 which, in turn, can be coupled to suitable base terminals. The molybdenum foils 8 have a length of about 30 mm and a width of 8 mm. The pinch seals 5 are secured at their remote ends with ceramic sleeve bases 10 with suitable holding cement. The sleeve bases 10 have a slit holding portion 11 and a flattened end portion 12, suitable for fitting into an appropriate socket.

The connecting foils 8 are so located within the pinch seals that at the sides facing the discharge region 3, the spacing of the ends of the foils from the ends of the pinch seals is about 4 mm, that is, the foils are recessed from these ends of the pinch seal by about 4 mm. Consequently, capillaries may form in the pinch seal only over that very short distance of 4 mm along the tungsten electrodes 6, in which metal halides may collect to form a metal halide sump. The wider sides 13 of the pinch or press seal are formed with terminal ridges or ribs 14 (FIG. 2a), so that the pinch seals 5 have an essentially double T-shaped cross section, that is, the two T regions abut each other along their shanks; they may also be considered to have the cross section, essentially, of an I-beam or an I-cross section.

The thickness d (FIG. 2A) of the pinch seal is about 4 mm. The width 14A of the broad face side 15 at the level of the end ridges or ribs 14 is about 7 mm, compare FIG. 2A. The thickness of the ribs is shown by T.

In accordance with a feature of the invention, the pinch seals, across their width W (16 mm), that is, across the wider of face sides 13, are formed with constrictions 16 extending over an axial length of about 5.5 mm. These constrictions are in the shape of two inclined surface regions—see FIG. 2—so that at the beginning of the end portion of the central region 3, the width of the wider or face side 13 of the pinch seal is decreased to 12 mm as shown at Wc, without, however, changing the thickness d of the pinch or press seal 5. At the same time, the thickness T of the terminal ridges 14 is increased and the width dimension 14a of ridges 14 widens towards the discharge region 3, forming ridges or ribs 17 (FIG. 1) primarily in the region of the inclined constriction. The thickness T of the end ridges 14 gradually increases from 7 mm to about 8 mm at the junction of the straight portion of the pinch seal with the inclined region, shown by line 18 in FIG. 1, and in FIG. 2. These ridges 14 further increase in thickness and, at the junction of the ribs or ridges 17 with the outer circumference of the discharge vessel 3, in the region shown at Wc, will have a thickness of about 10 mm.

The broad sides or faces 13 of the pinch seals are slightly ribbed, undulated, knurled or otherwise roughened -not seen in the figures. At the level of the electrode 6 and also of current supply 9 (see FIG. 2a), they are formed with external centering ridges or bumps or knobs 19a, 19b. Four zones of essentially flat surfaces 20a, 20b, 20c, 20d of at least approximately square dimension, and matching the curvature of the central region 3 in essentially tangential form, are formed in the end portions of the central vessel portion 3. They extend in the direction of the broad sides 13 as well as of the narrow sides 15 of the respective pinch seals. The four tangential surfaces 20a, b, c, d, together with the planes of the broad sides 13 and the narrow sides 15, respectively, form an obtuse angle, preferably between about 150° and 130°. This additionally constricts the discharge volume behind the electrodes, thus increasing the temperature of the cold spot within the discharge vessel when the lamp is in operation. Similar surfaces, of which only surfaces 20a; 20b; 20c; are identified in FIG. 1 are at the end of bulb 1 opposite surfaces 20a, 20b, 20c, 20d.

The discharge vessel 3 retains a fill of a noble gas, typically argon, used as an ignition and firing gas, and mercury, for example about 220 mg. Additionally, per cubic centimeter of the volume of the discharge vessel portion 3, rare earths are included. These rare earths are: $DyBr_3$ (1 μmol) and $TmBr_3$ (0.5 μmol), as well as 1 μmol of T1Br, 2 μmol of CsBr and 0.5 μmol of $ThJ_4$. The thorium may be replaced by hafnium. Overall, the fill provides for an initial color temperature of about 5700K. (prior art lamps: 5900K.), with a color rendering index of 92 (prior art: 90). The color locus of the fill, with the rare earths as above given, is: $x=0.333$; $y=0.346$. The pressure during operation is about 15 bar.

The lamp is suitable for a supply voltage of 380 V, and a lamp current of 10.3 A, with an arc voltage of 225 V.

The overall structure of the lamp, with 2000 W power rating, provides an increase of light output to 105 lm/W (in comparison to 100 lm/W with prior art lamps), while substantially increasing the lifetime of the lamp to about 2000 hours. The specific arc power is 67 W/mm.

The maximum bulb temperature of the discharge vessel, which, in accordance with the present invention, will be essentially isothermal, is about 1030° C., this forms the hot spot. The coldest temperature, that is, behind the electrodes at the end of the vessel, is about 1000° C., which compares with prior art cold spot temperatures of 940° C. At the end of the molybdenum foils 8, the temperature has dropped to 230° C. (prior art: 250° C.) when the lamp is in unconfined ambient surroundings. Within a reflector, or other light directing elements such as a search light or spot light, this corresponds to a temperature of 330° C. (prior art: 350° C.). The prior art lamp would be one which is identical to that of the present invention except that it will not have the constriction 16.

The special shape of the pinch seal, in comparison to prior art pinch seals, results in substantial improvement in the operating characteristics of the lamp, due to the heat damming effect of the constriction immediately adjacent the lamp bulb. The tangential surfaces at the end portions of the central region 3 further increase the temperature in the region behind the electrodes, which normally are the coldest region of the discharge vessel, that is, the region of the cold spot.

The luminous output is essentially constant over the entire operating life of the lamp. Thus, the light output maintenance is essentially uniform starting at an initial value of 205,000 lumens. The drop-off is only about 5%, which is substantially better than prior art lamps in which the drop-off is about 15%. The color temperature has an initial value of 5700K., as seen by the full-line curve in FIG. 3. In contrast to prior art lamps, in which the curve is illustrated in broken lines, the initial color temperature is 200K. less, and the change in color temperature is also less. The change in color temperature of the lamp in accordance with the present invention, $\Delta T = 500K.$, is substantially less during the operating life of the lamp, compared to the prior art lamp, $\Delta T = 900K.$, after 1500 hours of operation. The lamp has further advantages, namely in an improved arc voltage, which is 5–10% higher than prior art lamps, and a better stabilized re-ignition peak of 340 V at the start of lamp operation.

FIG. 4 illustrates the heat damming effect obtained by the specific shape of the pinch seal in accordance with the present invention, and particularly the constriction 16. FIG. 4, highly schematically, illustrates the wider or broad side of the pinch seal for an otherwise identical lamp according to the prior art, FIG. 4*a*, and in accordance with the present invention, FIG. 4*b*.

The temperature distribution in FIGS. 4*a*, 4*b* is illustrated by isothermals, that is, lines of equal temperature. The highest temperature is indicated by line a and line g is the lowest one. The temperature line d corresponds to about 350° C.

The prior art pinch seal, FIG. 4*a*, has a steep temperature gradient throughout its length, at the end of which a high temperature d remains. The pinch seal in accordance with the present invention, see FIG. 4*b*, includes the constriction 16. Consequently, the pinch seal is stressed substantially less under temperature, see curve e, and the temperature loading is substantially more uniform throughout the length of the pinch seal, particularly within the critical range of the foil melted into the pinch seal, and especially there, uniformly distributed. Overall, the temperature is lowered at the end of the base, which substantially improves the sealing effect of the melted-in foil, and decreases the stress on the pinch seal. The end zone of the pinch seal adjacent the discharge side could not be measured by currently available apparatus and, hence, the temperature curves cut off beyond the pinch seal.

The reinforcement ridges 17, extending from the pinch seal to the discharge vessel portion 3, have effectively eliminated breaks at the pinch seal.

Essentially the same construction of lamp can be used for one with 1000 W rating. Such lamps, in accordance with the prior art, had a heat damming coating of zirconium dioxide ($ZrO_2$) at the ends of the discharge vessel. This is not needed in accordance with the lamp of the present invention, so that the light absorbing effect and shading effect thereof are eliminated. This permits increase of the light output by about 5–10% to values corresponding to that of a 2000 W lamp on a per-watt basis.

A lamp having effectively the shape of the lamp 1 illustrated in FIGS. 1 and 2 can also be constructed with a power rating of, for example, 400 W or less. Such lamps, preferably, are located within an outer bulb and, overall, are smaller than the 1000 and up W lamps. The overall length of such a lamp is about 8.6 cm, and the pinch seals 5 have a length of about 20 mm each. 4 mm of that length is in the region of the constriction 16. The foils 8 then can have a length of 13 mm, sealed approximately centrally in the pinch seal, so that the electrode shaft and the outer current supply leads are embedded over a length of about 3.3 mm within the pinch seal.

The width dimension W of the pinch seal of about 16 mm is reduced to the constriction width Wc of about 9 mm. The thickness of the pinch seal is about 2 mm, and increases in the region of the end ridges or ribs 14 to 4 mm. The end ridges 14 themselves spread out over the length of the constriction to form the support and stiffening and reinforcing ribs 17, reaching a width of about 6 mm.

EMBODIMENT OF FIGS. 5 AND 6

The metal halide lamp of FIGS. 5 and 6 has a cylindrical outer bulb or vessel 21 formed of hard glass. The outer bulb is secured in a screw-in base 22, and closed off at the other end by a cap 23. A discharge vessel having a quartz glass bulb 24 is located coaxially within the outer bulb 21. The discharge vessel 24 has two oppositely facing electrodes located therein, suitably secured by a holder 25 in the outer bulb 21; two current supply leads 26 form part of the holder 25. The discharge vessel 24 is gas-tightly secured in the outer bulb 21, for example by being retained therein by a suitable gas-tight seal. The discharge vessel 24 has a tubular central body 27, the ends of which are sealed by a box-like end seal 28, without edge rims or ridges 14 however.

The width of the pinch seal corresponds to the outer diameter of the central tubular body 27. The pinch seal, as in the example of FIGS. 1 and 2, is formed with a constriction 29, which reduces the width of the pinch seal from 16 mm to 9 mm. The thickness of the pinch seal is about 2 mm. The narrow sides of the pinch seal spread out to the reinforcement ribs 30 (FIG. 6) which reach a thickness of 4 mm at the junction with the central region 27 of the lamp. The filling pressure during operation of such lamps, which have a power rating between 70 W and 400 W, is 15–25 bar.

METHOD OF MANUFACTURE OF THE LAMP

The start to make the lamp is a quartz glass bulb of, for example, a substantially bulbous or barrel-shaped central region (see for example FIG. 1) and two tubular end regions. Initially, an exhaust stub 50 is placed in the middle of the central region. An electrode system formed of an electrode, a molybdenum foil and an outer current supply lead is then introduced from below in the tubular end region, and there held in a suitable jig.

The electrode and the outer current supply leads are welded to the molybdenum foil.

The so partly assembled lamp is then flushed with argon gas. After flushing, the end region is heated by two gas burners to a deformation or pinching temperature, which is for quartz glass about 1700° C. The regions of the bulb which are within the range of deformation also much reach pinching or deformation temperature. Under continued flushing with argon, the end region is then pinch-sealed in a four-jaw compression or pinching machine.

In accordance with a feature of the invention, the jaws have two main jaws 31, FIG. 7*a*1, FIG. 7*a*2. They form the wider sides or faces 13 of the pinch seal. The pinch surface 32 of the main pinch seals has two recesses 33 for centering the electrode system, which will appear on the pinch seal as the centering ridges or centering bumps or knobs 19*b*.

In accordance with a feature of the invention, the end 34 facing the central region of the main pinch jaws is formed at the pinching surface with two lateral inclined surfaces 35, in order to permit interengagement with two auxiliary lateral pinch jaws 36 (FIG. 7*b*1, FIG. 7*b*2). A third inclined surface 37 (FIG. 7*a*1) recesses the pinch surface 32 adjacent its upper edge 34 by a chamfer or inclination of about 60°. This inclined surface 37, upon pinch-sealing, forms the tangential transition region with the central portion of the bulb. Steps 38 are formed at the lateral edges of the pinch surfaces. These steps 38 generate the end ridges 14 of the pinch seal.

Two auxiliary lateral pinch jaws 36 (FIG. 7*b*1, FIG. 7*b*2) cooperate with the main pinch jaws 31. The auxiliary pinch jaws 36 have a pinching or pressing surface 39 forming the narrow sides of the pinch seal. At the upper end of the pinch surface 39, a projection 40 extends, in peaked or roofed form, in which the ridge 41 extends parallel to the upper edge of the pinching surface 39. The lower inclined surface 42 of the peaked portion is inclined by 30° out of the plane of the pinching surface 39; the upper inclined portion 43 has an inclination of 50°, that is, is steeper with respect to the vertical direction. The lower surface 42 generates the constriction 16; the upper surface 43 generates the remaining tangential surfaces of the central region. The upper edge 34 of the main jaw is in alignment with the peak or ridge line 41 of the projection 40.

The reinforcement ridges at the ends are formed by the difference in inclination of the side surfaces 35 of the main jaws 31, which are inclined by 19°, and the inclination of the lower surface 42 of the auxiliary jaws 39. It has been found particularly desirable to move the auxiliary jaws with slight delay with respect to the main jaws, for example a delay of about ½ second.

The bulb is then reversed end-for-end, and the second end region is closed off with the same technology. Evacuating, flushing and filling with a suitable fill is done as well known through the exhaust stub 50 (FIGS. 1, 2). When the lamp is finished, the exhaust stub 50 is tipped off.

We claim:

1. High-pressure discharge lamp having an elongated bulb element defining a central bulb region (3) forming a discharge space, and two end regions (5, 28) opposite said central bulb region;

each of said end regions including a pinch or press seal, wherein each of said pinch or press seals defines two flattened, essentially parallel broad face surfaces (13) and two essentially parallel narrow side surfaces (15) which are narrower than said broad face surfaces;

a pair of electrodes (6) extending into the discharge space from said pinch or press seals;

current supply leads (9) electrically connected to said electrodes and passing through the respective pinch or press seals and extending externally of the bulb element;

connecting foils (8) located within said pinch or press seals, each of said foils being electrically connected to a respective electrode and a current supply lead; and an ionizable fill in the discharge space, and wherein the width of the broad face surfaces (13) of the pinch or press seals adjacent the central bulb region are constricted or indented so that the lateral regions of the broad face surfaces are formed with constrictions or indentations (16), said constrictions defining respective transition regions at the respective broad face surface of the respective pinch seal toward the central bulb region of the bulb element; and wherein the thickness (d) of the respective pinch or press seal including a region comprising said constrictions or indentations remains essentially constant throughout the extent of the respective pinch or press seal.

2. The lamp of claim 1, wherein the shape of each of the pinch or press seals, in cross section, is essentially in the shape of an I-beam or a double T, in which the shaft or shank elements of the respective T shapes abut each other, and wherein said broad face surfaces (13) terminate in side regions which define edge or end rims or ridges (14) enlarging the width of said narrow side surfaces (15).

3. The lamp of claim 2, wherein the side regions and said end ribs or ridges (14) widen in said transition region towards the central bulb region and form reinforcement ribs (17).

4. The lamp of claim 3, wherein the reinforcement ribs are located in said transition region in essential alignment with said constrictions or indentations.

5. The lamp of claim 1, wherein said broad face surfaces (13) are formed with at least one centering ridge (19) for centering at least one of: a respective electrode and a current supply lead.

6. The lamp of claim 1, wherein each of the electrodes is an essentially shaft-like element (6) extending into the respective pinch or press seal and only within the region of the constriction or indentation (16).

7. The lamp of claim 1, wherein the width of the broad face surface (13) is reduced by the constriction or indentation (16) by between about 30–50% with respect to a maximum width of the broad face surface.

8. The lamp of claim 1, wherein said constrictions or indentations define surfaces which are inclined with respect to an adjacent narrow side surface.

9. The lamp of claim 3, wherein the narrow side surfaces (15) increase in width by about 30% in a region of said constrictions or indentations (16).

10. The lamp of claim 1, wherein said constrictions or identations (16) extend over a length of between about 10–25% of the overall length of the respective one of the broad face surfaces (13).

11. The lamp of claim 1, wherein the central bulb region (3) is bulbous or barrel-shaped and defines two end portions (4) and a central region (3);

and wherein said end portions (4) of the central region (3) facing the pinch or press seals form essentially flat surfaces (20) which merge with curved surfaces of the central region in essentially tangential relationship.

12. The lamp of claim 1, wherein said lamp is an open lamp devoid of an outer surrounding bulb interacting thermally with said bulb.

13. The lamp of claim 1, wherein the fill comprises a metal halide.

14. The lamp of claim 1, wherein said lamp has a power rating of between about 150 to 4000 W.

15. A method of making a high-pressure discharge lamp as claimed in claim 1, comprising providing a glass bulb having a central bulb region (3) and two end regions;

pinch sealing a first electrode system comprising one electrode (6), a connecting foil (8) and one current supply lead (9) into a first end region;

pinch sealing a second electrode system comprising a second electrode (6), a second connecting foil (8) and a second current supply lead (9) in the second end region;

evacuating, flushing and filling the discharge spaced formed by said central bulb region; and wherein the pinch sealing steps, each, comprise heating the end regions and an adjacent transition portion to the central bulb region to softening temperature;

forming said broad face surfaces by moving a pair of main pinch jaws (31) which have laterally inclined relief surfaces (35) towards said softened end regions; and further moving two auxiliary side pinch jaws (36) towards said end regions, in which said auxiliary side pinch jaws have, with respect to pinching movement of said auxiliary side pinch jaws, inclined, inwardly directed essentially flat surface regions (42) terminating in a projecting tip portion (40), and, in a direction towards said glass bulb, backwardly receding surface portions (43), said surface regions (42) projecting at an inclination with respect to the major dimension of the pinch or press seal and movable towards said laterally inclined relief surfaces (35) of the main pinch jaws (31) to form said constrictions or indentations, said laterally inclined relief surfaces of the main pinch jaws and said receding surface portions (43) of the auxiliary side pinch jaws permitting escape of glass material from said glass bulb displaced by said inwardly directed essentially flat surface regions (42) forming said constrictions or indentations.

16. The method of claim 15, including the step of forming reinforcement ribs in said transition portion, said step of forming the reinforcement ribs comprising providing said main pinch jaws (31) with lateral relief surfaces (35) shaped to cooperate with said said auxiliary pinch jaws (36) having said inclined surface (42), and wherein the lateral relief surfaces (35) have different angles of inclination from said inclined surfaces.

17. The method of claim 15, including the step of forming tangential surfaces in the transition portion by forming the pair of the main mutually oppositely movable pinch jaws (31, 39) in a region adjacent a pinching surface and the receding surface portions (43) of the auxiliary pinch jaws (36) as essentially flat surfaces.

18. The method of claim 15, wherein said pinch or press sealing step comprises moving said auxiliary pinching jaws (39) towards each other with a time delay with respect to the movement of the main pinching jaws (31).

19. The method of claim 15, including the step of forming centering buttons or ridges for said electrode systems, said step of forming the centering buttons or ridges (19*b*) comprising forming centering grooves or recesses (33) in the main pinching jaws (31).

* * * * *